US009601888B2

(12) United States Patent
Ueda et al.

(10) Patent No.: US 9,601,888 B2
(45) Date of Patent: Mar. 21, 2017

(54) BRUSH TYPE CONTACT MATERIAL AND MANUFACTURING METHOD FOR THE SAME

(71) Applicant: Tanaka Kikinzoku Kogyo K.K., Tokyo (JP)

(72) Inventors: Kazuo Ueda, Hiratsuka (JP); Yukimasa Nomura, Hiratsuka (JP)

(73) Assignee: TANAKA KIKINZOKU KOGYO K.K., Tokyo (JP)

( * ) Notice: Subject to any disclaimer, the term of this patent is extended or adjusted under 35 U.S.C. 154(b) by 28 days.

(21) Appl. No.: 14/652,195

(22) PCT Filed: Dec. 13, 2013

(86) PCT No.: PCT/JP2013/083422
§ 371 (c)(1),
(2) Date: Jun. 15, 2015

(87) PCT Pub. No.: WO2014/097975
PCT Pub. Date: Jun. 26, 2014

(65) Prior Publication Data

US 2015/0318651 A1 Nov. 5, 2015

(30) Foreign Application Priority Data

Dec. 21, 2012 (JP) ..... 2012-279443

(51) Int. Cl.
*H01R 43/12* (2006.01)
*H01R 43/16* (2006.01)
(Continued)

(52) U.S. Cl.
CPC ..... *H01R 39/00* (2013.01); *H01C 1/12* (2013.01); *H01C 10/28* (2013.01); *H01R 43/16* (2013.01)

(58) Field of Classification Search
CPC ..... H01C 1/12; H01C 10/11; H01C 10/30; H01R 39/18; H01R 43/12; H01R 43/16;
(Continued)

(56) References Cited

U.S. PATENT DOCUMENTS 3,733,573 A * 5/1973 Dieterich ..... H01C 1/12 29/826
3,927,887 A * 12/1975 Oda ..... G11B 3/44 369/173
4,345,372 A * 8/1982 Sekigawa ..... H01H 11/04 29/874
7,096,582 B2 * 8/2006 Sayama ..... H01C 10/30 219/121.66
7,238,902 B2 * 7/2007 Sayama ..... G11B 5/4853 200/239
2007/0035196 A1 * 2/2007 Sidgwick ..... H01R 39/24 310/249
2012/0058692 A1 * 3/2012 Huang ..... C23C 18/1651 439/886
(Continued)

FOREIGN PATENT DOCUMENTS

JP 5226103 A 9/1993
JP 6289051 A 10/1994
(Continued)

OTHER PUBLICATIONS

PCT, International Search Report PCT/JP2013/083422, Feb. 25, 2014.

*Primary Examiner* — James Harvey
*Assistant Examiner* — Matthew T Dzierzynski
(74) *Attorney, Agent, or Firm* — Orrick Herrington & Sutcliffe, LLP

(57) ABSTRACT

The present invention relates to a brush type contact material, including one or more curved metal pawls of which ends come into contact with objects to be contacted. The ends of the pawls have an arc-like cross section in a thickness direction, a curvature radius R1 on a front side from a contact point with the object to be contacted and a curvature radius R2 on a back side from the contact point are formed so as to be R1≥R2, and also both ends in a width direction of the pawl are chamfered. At this time, preferably, R1 is larger than R2 (R1>R2), and R1 divided by R2 (R1/R2) is 3.0 or less. The brush type contact material according to the present invention enables a smoother sliding movement than ever before and can be relatively simply manufactured.

4 Claims, 5 Drawing Sheets

(51) Int. Cl.
*H01C 10/28* (2006.01)
*H01R 39/00* (2006.01)
*H01C 1/12* (2006.01)

(58) Field of Classification Search
CPC ..... H01H 11/104; Y10T 29/49119; Y10T 29/49204; Y10T 29/49218
See application file for complete search history.

(56) References Cited

U.S. PATENT DOCUMENTS

2015/0279768 A1* 10/2015 Rathburn ..... H01L 23/49811 174/251

FOREIGN PATENT DOCUMENTS

JP 2001-351807 A 12/2001
JP 2003-347110 A 12/2003

* cited by examiner

EXAMPLE 1

EXAMPLE 3

BRUSH TYPE CONTACT MATERIAL AND MANUFACTURING METHOD FOR THE SAME

TECHNICAL FIELD

The present invention relates to a brush type contact material used as a sliding contact in a sensor such as a position sensor and a resistor such as a potentiometer.

BACKGROUND ART

In a sensor such as a position sensor and each type of in-vehicle sensors (a throttle sensor, a pedal sensor, and a vehicle height sensor) and a resistor such as a potentiometer and a trimmer, a slider 100 is used for transmitting and receiving such as an electrical signal and power between a substrate member on a main body side of the sensor and an assembly rotating or moving straight with respect to the main body side substrate (FIG. 1). The slider 100 includes a brush type contact material 10 of which ends are slidingly contacted with a rotor of the sensor. Multiple pawls 11 curved at around a contact point with the substrate are connected in the brush type contact material 10. An end of each pawl 11 is used in a state coming into slidingly contact with the substrate to be contacted, and therefore a pawl end 11*a* preferably slidably moves as smooth as possible.

In manufacture of a brush type contact material, first a sliding contact piece (see FIG. 2), which is flat and not curved, is manufactured by punching by press. On this occasion, punching often produces burrs around a pawl end of a brush by, and thereby sharpening the end. If the burrs remain in the pawl end, the pawl end does not smoothly slide, and therefore, an end of a punched sliding contact piece is normally formed in a curved shape.

Barrel polishing was once used as a method for forming, in a curved shape, an end portion of a punched sliding contact piece. The barrel polishing is a method in which abrasive media such as grind stones and pressed sliding contact pieces are put in a container, and the overall periphery of the sliding contact pieces are polished by rotation of the container. The barrel polishing is an effective means capable of polishing multiple small-sized sliding contact pieces at the same time. However, the barrel polishing is not a method for intensively polishing a specific portion and is not suitable to certainly curve a surface of an end portion. Also, a polishing state is likely to vary.

An applicant of the present application proposes a manufacturing method using a laser beam and a contact material manufactured by the manufacturing method with respect to a method for manufacturing a brush type contact material by the above barrel polishing. This manufacturing method is a method in which pawl ends of pressed sliding contact pieces are melted and coagulated by sequential irradiation with a laser beam. In this manufacturing method, a curved surface processing can be performed only to pawl ends, and also a material with a constant quality without variations can be effectively manufactured through setting an appropriate laser beam irradiation conditions. In a brush type contact material manufactured by this method, a pawl end has a balanced curved surface shape such as a sectional arc-like shape, has a smooth surface, and enables a smooth sliding movement.

RELATED ART DOCUMENT

Patent Documents

Patent Document 1: Japanese Patent No. 3847211

SUMMARY OF THE INVENTION

Problems to be Solved by the Invention

As described above, a smooth sliding movement on a pawl end is required to a brush type contact material, and the balanced curved surface shape formed by the above laser processing can meet the needs to some extent. However, a material capable of a smoother sliding movement is required. Also, by a curved surface processing with the above laser processing, material structure of a portion melted and coagulated by the laser irradiation changes, and the hardness of the portion lowers. Accordingly local wear/deformation is likely to occur, and it is hard to maintain the curved surface shape. Therefore, the hardness needs to be adjusted by heating after laser irradiation. However, the heating leads to increase in the number of processes for manufacturing a contact material.

Furthermore, in the case of the brush type contact material by laser processing, although a melted/coagulated end shape comes close to a spherical shape, the shape cannot be controlled. According to laser irradiation conditions, a center of a semicylindrical curved surface shape intensively swells, and a stable sliding movement cannot be obtained.

The present invention discloses a brush type contact material which is capable of a smoother sliding movement and can be relatively simply manufactured and a manufacturing method for the brush type contact material.

Means for Solving the Problems

To solve the above problem, the present invention provides a brush type contact material including one or more curved metal pawls of which ends come into contact with objects to be contacted, wherein the ends of the pawls have an arc-like shape on a section in a thickness direction, a curvature radius R1 on a front side from a contact point with the object to be contacted and a curvature radius R2 on a back side from the contact point are formed so as to be R1≥R2, and also both ends in a width direction of the pawl are chamfered.

The brush type contact material according to the present invention has an arc-like shape in cross-section by shape control of a pawl end, and a case in which curvature radiuses of the front and back sides are different is included in addition to a case in which the curvature radiuses are equal. Furthermore, the both ends in a width direction of a pawl are formed by chamfering.

A purpose for adjusting a curvature of a pawl end in the present invention will be described later in detail. On the other hand, the both ends in a width direction of the pawl are chamfered because local wear might occur at a contact point on the other side if angles of the both pawl ends are sharp in the case where an eccentric load is applied while the contact point is used. The local wear by an eccentric load while the contact point is used can be reduced by chamfering the both pawl ends.

Regarding a cross sectional arc-like shape of a pawl end, a relation between the curvature radius R1 on a front side from a contact point with an object to be contacted and the curvature radius R2on a back side from the contact point is preferably set to R1>R2. The reason is that increase of R1 on an outer side prevents a stick slip phenomenon from occurring, and ensures a smoother sliding movement of a contact material. Another reason is that decrease of R2 on an inner side suppresses peripheral scattering of cutting powder generated in association with sliding of a contact material, by drawing the cutting powder.

Especially, in the relation between R1 and R2, R1 divided by R2 (R1/R2) is preferably 3.0 or less. While the brush type contact material is usually used, a curvature of a pawl is set so that a brush and a substrate come into contact at an angle of 70° to 85° (see FIG. 3). In this case, by setting to R1/R2=1.0 to 3.0, a joint position of R1 and R2 assumes an approximate position with a contact point and stable sliding becomes possible.

Also, in the present invention, although both pawl ends are chamfered in addition to adjusting a sectional shape of the pawl end, the both ends W/10 to W/4 of a brush width W is preferably chamfered. As a shape of the chamfered portion, chamfering of 10° to 45° (R connection) or round chamfering of R 0.15 to R 0.5 is preferably performed (see FIG. 4). This is for suppressing burring and ensuring stable connection.

Metal, which is similar metal used in a conventional contact material, is applied to the contact material. Especially, Ag based alloys (for example, Ag: 39.5 wt %, Pd: 43.0 wt %, Cu: 17.0 wt % Pt: 0.5 wt % or Pt 10 wt %, Au: 10 wt %, Ag: 30 wt %, Pd: 35 wt %, Cu: 14 wt %, Zn: 1 wt % are known) are suitable because the Ag based alloys have excellent conductivity as a contact material and have satisfactory spring property and hardness(abrasion resistance property).

In the manufacture of the brush type contact material according to the present invention, a strip material in which multiple pawls are connected is firstly punched from a metal board. Then, although a pawl end of the strip material is formed in a shape described above, the forming method may be based on a laser processing by an applicant of the present invention. By applying the laser processing, the pawl end becomes smooth and is formed in a balanced curved surface shape such as a cross-sectional arc-like shape. As described above, both pawl ends of the laser-irradiated contact material is chamfered by polishing.

In processing of the pawl ends by laser processing, the pawl ends are sequentially irradiated with a laser beam and melted/coagulated in a state in which a punched strip material is maintained. As described above, the material hardness of a melted portion is lowered by the laser processing, and the portion cannot be used as a brush type contact material in the state. Therefore the hardness is adjusted by heating.

In the manufacturing method applying the above laser processing, a well-balanced arc-like shape (R1 and R2 are almost equal) can be obtained by setting conditions. However, R1 and R2 cannot be separately formed and a relation between them cannot be adjusted. Also, heating after laser processing is needed to secure the hardness, and therefore the number of processes increases. Preferably, a punched strip material is fixed, and a pawl end is sequentially polished with a grind stone.

By polishing with a grind stone, a shape of a pawl end can be freely formed by adjusting a position and an angle the grind stone is applied. Especially, an end portion having partially different R can be formed. Also, a surface roughness of the pawl end can be adjusted by appropriately selecting a grain size of the grind stone. Furthermore, mechanical polishing enables forming the pawl end without generating a heat-affected zone and changing metal composition. Therefore, a polished material can be used in the state.

When the pawl end is polished, a grind stone is applied to the pawl end. The pawl end of a strip material is half-fixed at this time. During polishing, the half-fixed strip material is likely to escape from the grind stone. On the other hand, the grind stone is likely to jam the strip material. By using the conflicting movement, the pawl end can be gradually and properly polished in an R shape.

A grind stone having a sufficient width capable of polishing dozens or tens of pawls at the same time is used. The grind stone comes into contact with and passes through a pawl end while rotating and shaking from a vertical direction of a strip material. The R on the front and back sides of a pawl end and chamfering of the end portion can be controlled by a holding angle, a feeding speed, a grind stone cutting depth, and a rotation speed of a strip material during polishing. During the polishing, a portion other than the pawl end polishing portion of the punched strip material is preferably masked.

Advantageous Effects of the Invention

A brush type contact material according to the present invention is capable of appropriately forming a pawl end shape, smoothly sliding with respect to the other side substrate, and maintaining the hardness of a component metal. The brush type contact material according to the present invention can be manufactured after a process of polishing a pawl end with a grind stone.

DESCRIPTION OF EMBODIMENTS

Figure 1:
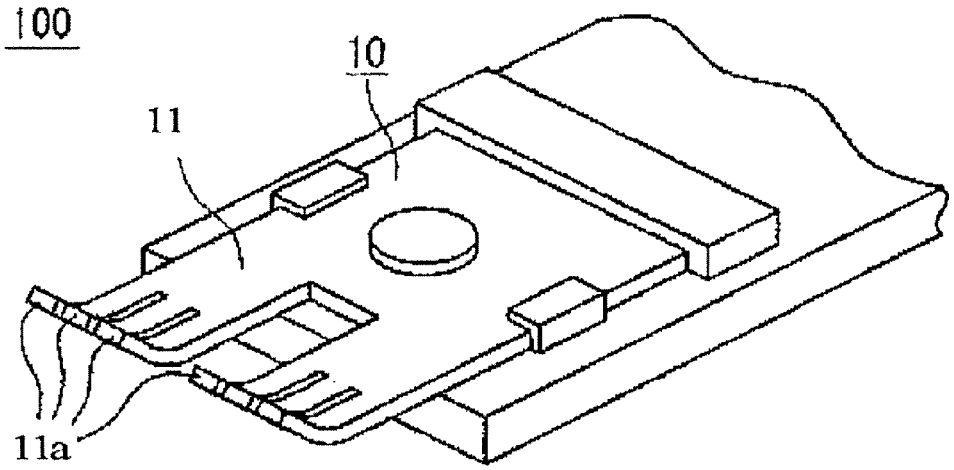
FIG. 1 illustrates an appearance of a slider including a general brush type contact material.
Figure 2:
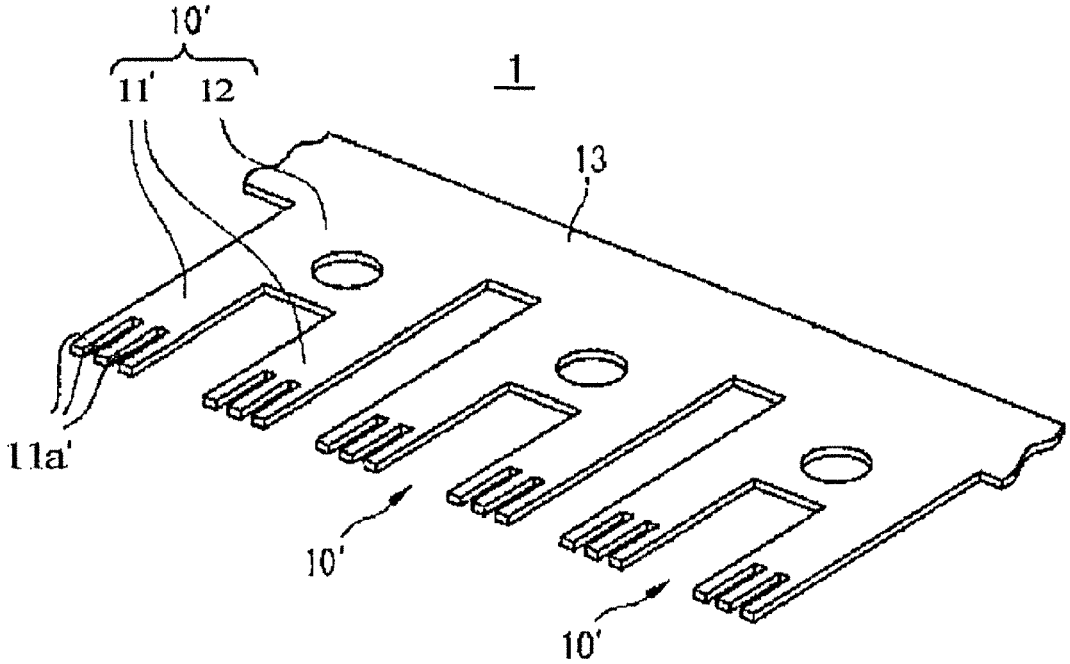
FIG. 2 illustrates an appearance of a strip material of a contact piece of a punched sliding material.
Figure 3:
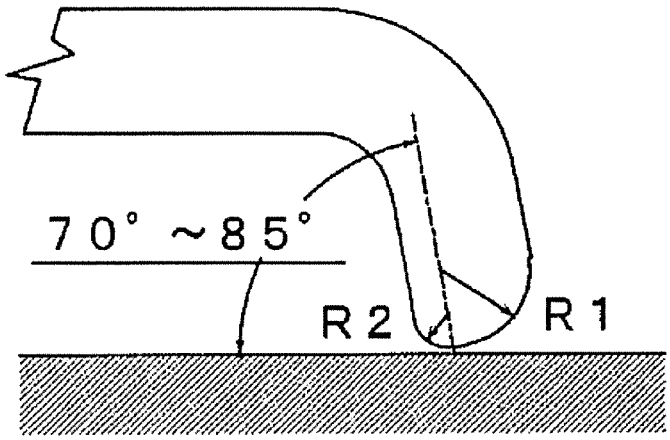
FIG. 3 illustrates a cross-sectional shape of a pawl end of the brush type contact material according to the present invention.
Figure 4:
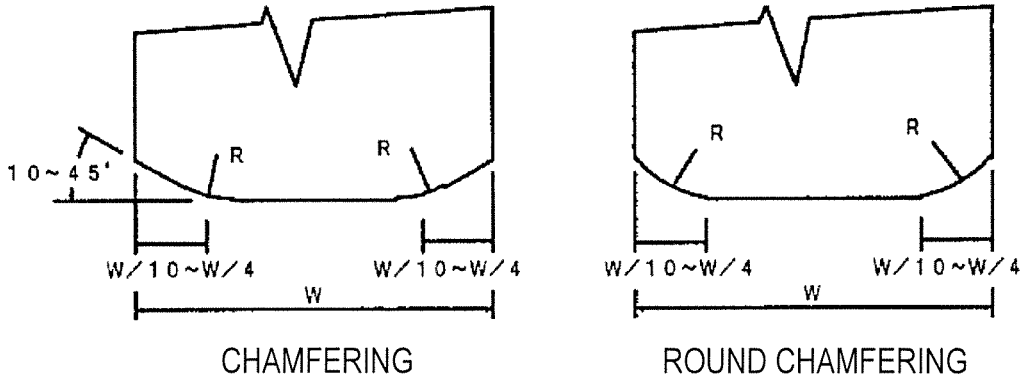
FIG. 4 is a diagram illustrating a processing example of both pawl ends of the brush type contact material according to the present invention.

Hereinafter, preferred examples of the present invention will be described. A thin plate material having a width of 23 mm and a thickness of 0.12 mm was prepared by rolling it to the material with a composition of Ag 39.5 wt %, Pd 43.0 wt %, Cu 17.0 wt %, and Pt 0.5 wt %. A strip material 1, in which multiple sliding contact pieces 10' were connected in a belt shape as illustrated in FIG. 2, was obtained by pressing the thin plate material.

Each sliding contact piece 10' has a base 12, two brushes 11' extending from the base 12, and is connected to the adjacent sliding contact pieces 10' in the base 12 via a cutting margin 13. Each brush 11' has three pawls (a width diameter is 0.4 mm) which have the same length and are formed in a comb-tooth shape. Also, in the both brushes 11', pawl ends 11*a*' are arranged in parallel and are arranged on a straight line.

Figure 5:
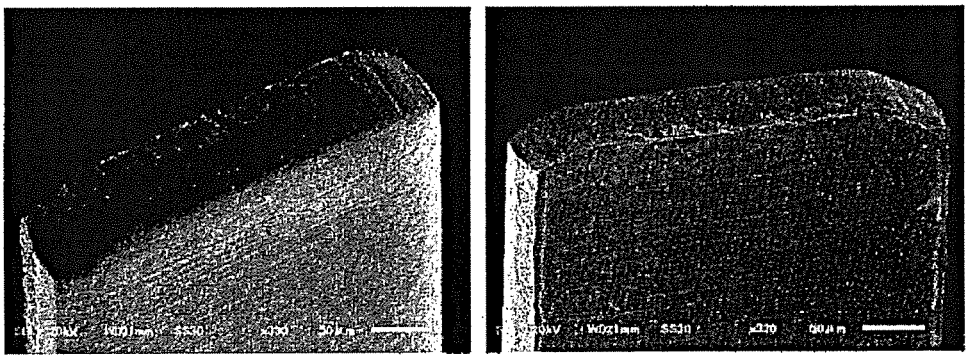
FIG. 5 is a photograph showing a pressed pawl end according to the present embodiment.

FIG. 5 is a photograph showing a pressed pawl end. A surface of the pawl end 11*a*' in this stage was rough by punching by press. A shape of the end portion was asymmetrically, and an outline of an inwardly pressed end surface was an irregular (indefinite) curved shape. In detail, the end portion includes a shearing (press-sag) surface in an initial punching stage and a fracture (press-burr) surface in a later punching stage.

After pressing, the pawl end was polished. Polishing was performed in a half-fixed state while masking a portion other than the pawl end polishing portion 11*a*' of a punched strip material and holding the cutting margin 13 while providing the cutting margin 13 under a grind stone. The grind stone having a width capable of polishing the multiple pawl end polishing portions 11*a*' at the same time came into contact with and passed through the end polishing portion 11*a*' while rotating and shaking from a vertical direction of the strip material. Also, a holding angle and a feeding speed of the strip material during polishing and a cutting depth and a rotation speed of a grind stone were controlled when a pawl end, of which R1 and R2 on front and back sides are different, was polished. For example, polishing angles of strip materials in Examples 1 to 3 to be described below were set to 45°. Also, although polishing angles of strip materials in Examples 4 to 6 were 30° in common, a cutting depth and a rotation speed of a grind stone were changed.

After polishing as described above, a brush type contact material was obtained in which sliding contact points having pawls curved by bending were connected in a belt shape. A shape of a pawl end according to each example will be as follows. R1 and R2 of a pawl end were measured on a center section of a pawl.

TABLE 1

| | Sectional shape | | Chamfering of |
|---|---|---|---|
| | R1 | R2 | end portion |
| Example 1 | 0.08 | 0.04 | 30° |
| Example 2 | 0.06 | 0.05 | 15° |
| Example 3 | 0.06 | 0.03 | R0.3 |
| Example 4 | 0.06 | 0.06 | 45° |
| Example 5 | 0.045 | 0.045 | R0.2 |
| Example 6 | 0.03 | 0.03 | 30° |

Figure 6:
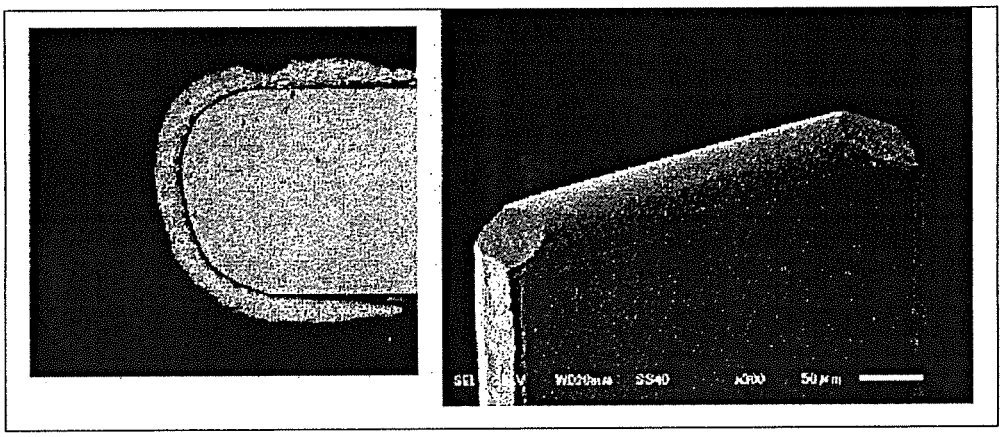
FIG. 6 is a photograph showing a pawl end after polishing according to Example 1.
Figure 7:
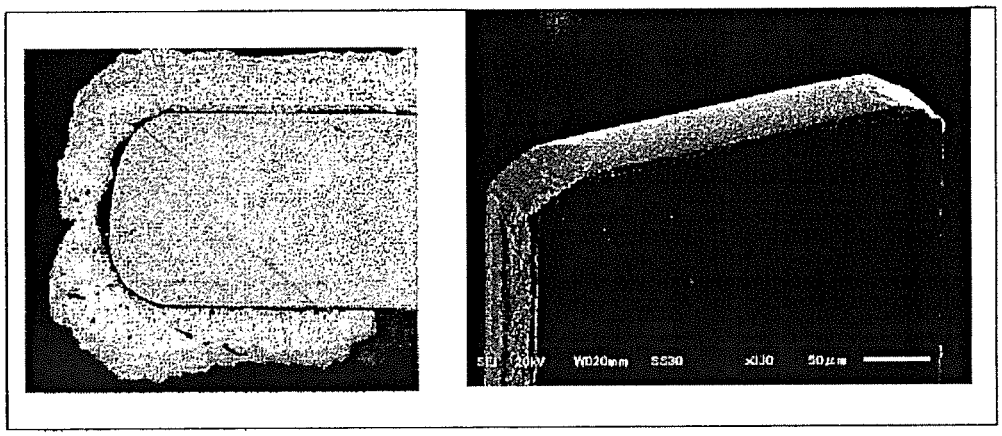
FIG. 7 is a photograph showing a pawl end after polishing according to Example 3.
Figure 8:
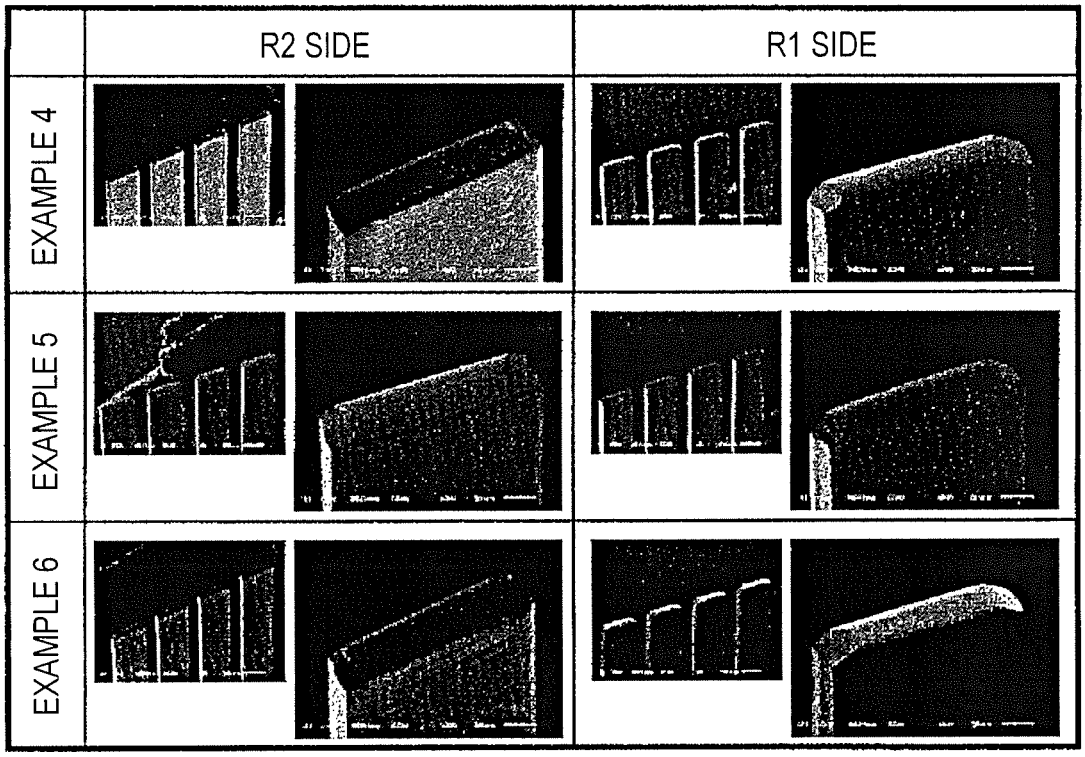
FIG. 8 is a photograph showing a pawl end after polishing according to Examples 4 to 6.

FIGS. 6 and 7 are photographs showing the pawl 11*a* ends of the brush type contact materials according to Examples 1 and 3, respectively. A surface of the pawl end of the obtained brush type contact material was smooth. Also, in the sectional photographs, R shapes on the front and back sides are different. The both ends have inclination by chamfering. FIG. 8 is a photograph showing the pawl 11*a* ends according to Examples 4 to 6. The pawl ends according to these examples had entirely uniform semicylindrical shapes.

Figure 9:
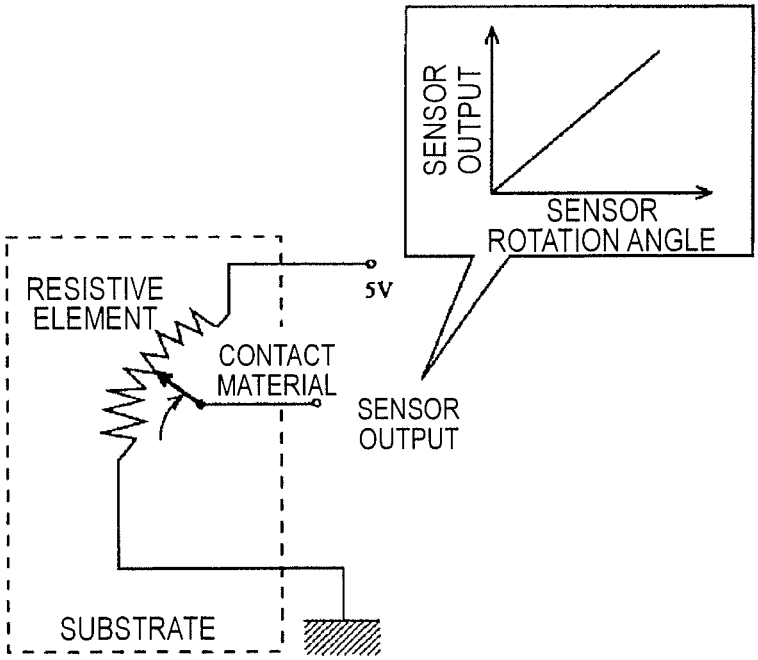
FIG. 9 is a schematic view of a brush evaluation circuit used in the present embodiment.

Next, a durability test was conducted on a contact material according to each example for evaluation of electrical characteristics. FIG. 9 is a schematic view of a brush evaluation circuit. A brush type contact material is horizontally attached to a substrate having an arc-shaped resistive element so that an output becomes 0V at an angle of 0°, and the output becomes 5V at the angle of 90°. In the durability test, the brush type contact material was slid for 200 million times on the resistive element illustrated in FIG. 9, and then electrical characteristics (linearity) was measured. In the measurement of linearity, a sensor output voltage (an angle vs. an output voltage from a brush) was measured while changing a brush angle by applying a constant voltage to the resistive element according to FIG. 9 (an angle range of the both ends was excluded since an error becomes large). In the measurement, the linearity was evaluated by setting a displacement between a reference output voltage (logical output) and an output potential from a brush as a change rate %.

Figure 10:
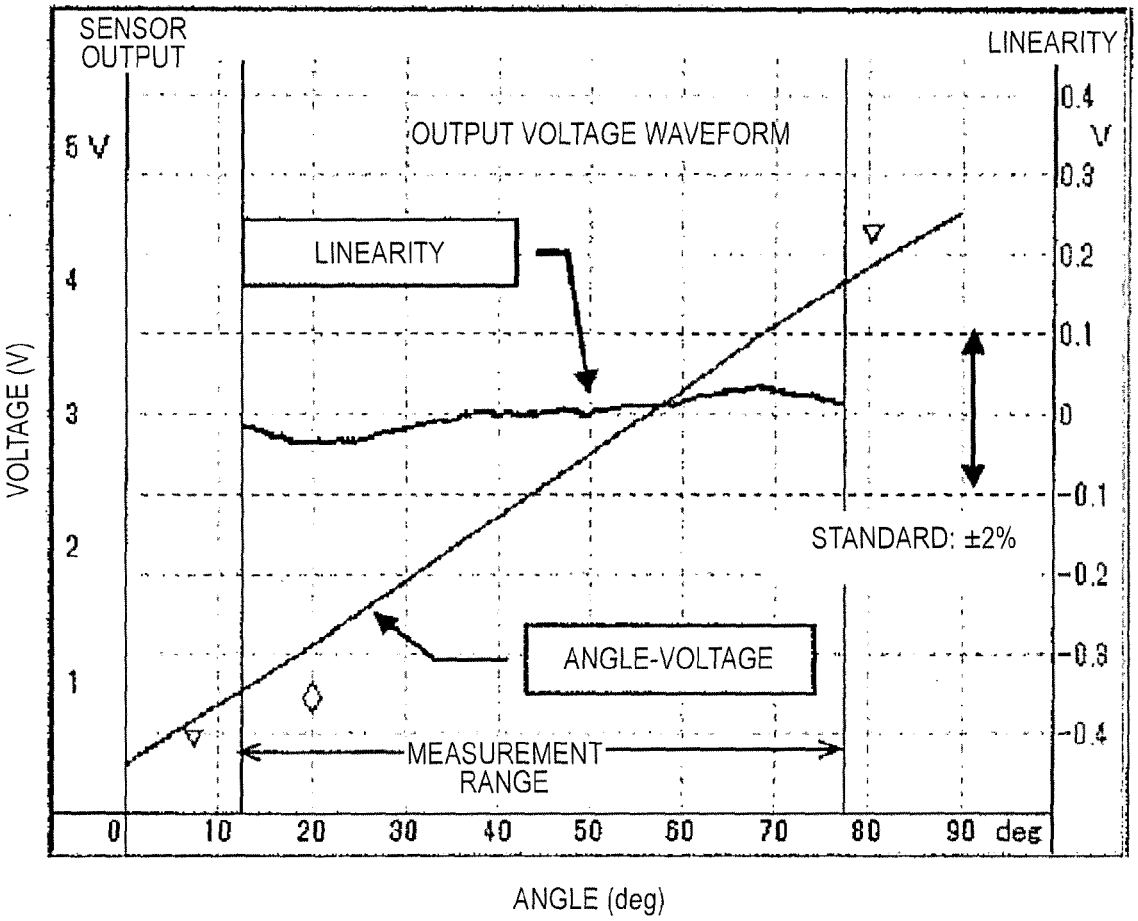
FIG. 10 is a diagram illustrating a measurement result of linearity after a durability test according to Example 1.

FIG. 10 illustrates an example of the linearity measurement results and illustrates the linearity measurement results after the durability in Example 1. Angle-voltage data refers to a left side main scale, and linearity refers to a right side sub scale. FIG. 10 indicates that the linearity according to this example has a range (linearity) of ±0.7% with respect to a logical value and has excellent linearity after a durability test. It is said that linearity within ±2.0% is required as an in-vehicle component standard to satisfy the regulation of emissions from motor vehicles. Hereinafter this regulation might be tightened, and linearity of ±1.5% might be required for further performance upgrade. The contact material according to Example 1 can satisfy the strict standard. Table 2 illustrates the linearity measurement result according to each example.

TABLE 2

| | Linearity change rate |
|---|---|
| Example 1 | ±0.7% |
| Example 2 | ±0.8% |
| Example 3 | ±0.9% |
| Example 4 | ±1.1% |
| Example 5 | ±1.2% |
| Example 6 | ±1.6% |

Table 2 indicates that all of the brush type contact materials according to Examples 1 to 6 have linearity of ±2% or less and have characteristics satisfying the current in-vehicle component standard. Also, it was confirmed that an outstanding characteristics result of ±1% or less could be obtained by differing R1 and R2 like Example 1.

INDUSTRIAL APPLICABILITY

As described above, the brush type contact material according to the present invention enables a smoother sliding movement than ever before as a result of considering a pawl end shape in detail. This brush type contact material can be relatively simply manufactured without heating after forming and without changing mechanical properties the configuration material has. The present invention is preferred as a contact material of a slider in a sensor such as a position sensor and a resistor.

The invention claimed is:

1. A brush type contact material, comprising one or more curved metal pawls for coming into contact with objects to be contacted, wherein each metal pawl has a contact end having a contact point;

wherein a cross section normal to the length of each metal pawl is of substantially constant width and thickness along the length of the metal pawl;

wherein each metal pawl is concave on a back side from the contact point and convex on a front side from the contact point;

wherein the contact end of each pawl has a curvature in a thickness direction, including a curvature radius R1 on the front side from the contact point and a curvature radius R2 on the back side from the contact point such that the curvatures R1 and R2 are on opposing sides of the contact point; and wherein R1≥R2, and R1/R2 is 3.0 or less.

2. The brush type contact material according to claim 1, wherein the both ends in a width direction of the pawl are chamfered or round-chamfered within a range of W/10 to W/4 of a brush width W at the both ends.

3. A manufacturing method for a brush type contact material, the contact material defined in claim 1, comprising the steps of:

punching a strip material, in which multiple metal pawls are connected, from a thin plate; and forming by polishing the pawl ends by applying a grind stone while holding the strip material in a semi fixed state.

4. The brush type contact material according to claim 1, wherein the contact end is configured such that the contact end will come into contact with a substrate, which is an object to be contacted, at an angle in the range of 70° to 85°.

* * * * *